US007435204B2

(12) United States Patent
Wu et al.

(10) Patent No.: US 7,435,204 B2
(45) Date of Patent: Oct. 14, 2008

(54) ELLIPTICAL EXERCISE MACHINE WITH ADJUSTABLE EXERCISING ORBIT

(75) Inventors: Hung-Sheng Wu, Tuku Township, Yunlin County (TW); Chun-Ho Chen, Taiping (TW); Chia-Hsiun Chuang, Changhua (TW)

(73) Assignees: Cycling & Health Tech Industry, Taichung (TW); R & D Center, Taichung (TW)

( * ) Notice: Subject to any disclaimer, the term of this patent is extended or adjusted under 35 U.S.C. 154(b) by 175 days.

(21) Appl. No.: 11/435,489

(22) Filed: May 16, 2006

(65) Prior Publication Data

US 2007/0042871 A1 Feb. 22, 2007

(30) Foreign Application Priority Data

Aug. 19, 2005 (TW) ..... 94214211 U

(51) Int. Cl.
*A63B 22/00* (2006.01)
*A63B 22/04* (2006.01)

(52) U.S. Cl. ..... 482/52; 482/51; 482/57

(58) Field of Classification Search ..... 482/51–53, 482/57, 70, 79–80
See application file for complete search history.

(56) References Cited

U.S. PATENT DOCUMENTS

| | | | | |
|---|---|---|---|---|
| 5,595,553 | A * | 1/1997 | Rodgers, Jr. | 482/51 |
| 5,637,058 | A * | 6/1997 | Rodgers, Jr. | 482/51 |
| 5,766,113 | A * | 6/1998 | Rodgers, Jr. | 482/52 |
| 6,746,377 | B2 * | 6/2004 | Johnston | 482/57 |

* cited by examiner

*Primary Examiner*—Steve R Crow
(74) *Attorney, Agent, or Firm*—Charles E. Baxley

(57) ABSTRACT

An elliptical exercise machine with an adjustable exercising track comprises a framework, having a flywheel, a crank settled on the flywheel, and at least two parallel rails; a wheel assembly, comprising two wheel-shafts arranged at two sides of the crank and two wheels slidably coupled to the rails; a handle-shaft assembly, comprising a pair of handle-shafts disposed at two sides of the framework for being gripped by a user; a stepping-pedal assembly, comprising two pedals coupled to two pedal-shafts which are linked to the handle-shafts; and a pair of adjusting assemblies for shifting positions of joints of the pedal-shafts and the wheel-shafts along the wheel-shafts. By shifting the positions of joints of the pedal-shafts and the wheel-shafts, a minor axis of the elliptical exercising track can be lengthened or shortened and consequently the elliptical exercising track can be non-proportionally scaled.

9 Claims, 7 Drawing Sheets

ELLIPTICAL EXERCISE MACHINE WITH ADJUSTABLE EXERCISING ORBIT

BACKGROUND OF THE INVENTION

1. Field of the Invention

This invention is related to an elliptical exercise machine, and, more particularly, to an elliptical exercise machine with an adjustable elliptical exercising track that can be non-proportionally scaled by lengthening or shortening a minor axis of the elliptical exercising track so as to allow a user to exercise in diverse exercise modes for training his/her various muscle systems.

2. Description of the Related Art

A conventional elliptical exercise machine generally provides a fixed elliptical exercising track for pedals thereof to move along, and an adjustable exercising strength that can be modified by adjusting a resistance acting on a flywheel thereof. However, as the exercising track is fixed, when using such conventional machine, a user can only have a limited range of his/her muscle systems trained. Consequently, the user's exercising mode is constant. To add more flexible exercising modes for training a user's leg strength and muscle endurance, elliptical exercise machines with adjustable exercising tracks have been introduced to the market.

Such adjustable exercising track of the known elliptical exercise machine is a result of adjustable step length and adjustable inclination, wherein the adjustable step length is adjusted by proportionally scaling the overall exercising track or a major axis of the exercising track while the inclination involves changing the gradient of the entire exercising track. Thus, a need exists for an elliptical exercise machine with an adjustable exercising track that can be non-proportionally scaled by lengthening or shortening a minor axis of the elliptical exercising track.

SUMMARY OF THE INVENTION

The primary objective of the present invention is to provide an elliptical exercise machine having an adjustable exercising track, wherein an adjusting assembly is provided on each of two wheel-shaft of the elliptical exercise machine and connected to each of two pedal-shafts. The adjusting assembly serves to shift a joint of the pedal-shaft and the wheel-shaft along an axis of the wheel-shaft. Thereby, a user can lengthen or shorten a minor axis of the elliptical exercising track by adjusting positions of the joints of the pedal-shafts and wheel-shafts along the axes of the wheel-shafts, so as to non-proportionally scale the exercising track and provide diverse exercising modes for training various muscle systems of the user.

The technical measures taken by the invention to achieve the foregoing objective are given below.

An elliptical exercise machine with an adjustable exercising track substantially comprises:

a framework, which includes an upright support mounted on a longitudinal base member, a flywheel axially settled inside said upright support, a crank settled on the flywheel, and at least two parallel rails arranged along said longitudinal base member, a wheel assembly, which comprises two wheel-shafts pivotally connected to two ends of said crank, and wheels provided at opposite ends of the wheel-shafts for slidably coupled with the rails;

a handle-shaft assembly, which comprises a pair of handle-shafts disposed at two sides of the upright support, in which the handle-shaft has a top portion for being gripped by a user;

a pedal-shaft assembly, which comprises two pedal-shafts pivotally connected to bottoms of the handle-shafts, and two pedals coupled to opposite ends of the pedal-shafts for being pedaled by the user; and a pair of adjusting assemblies, each being pivotally connected to a respective said pedal-shaft and serving to shift a joint of the pedal-shaft and the wheel-shaft along an axis of the wheel-shaft.

DETAILED DESCRIPTION OF THE PREFERRED EMBODIMENTS

Figure 1:
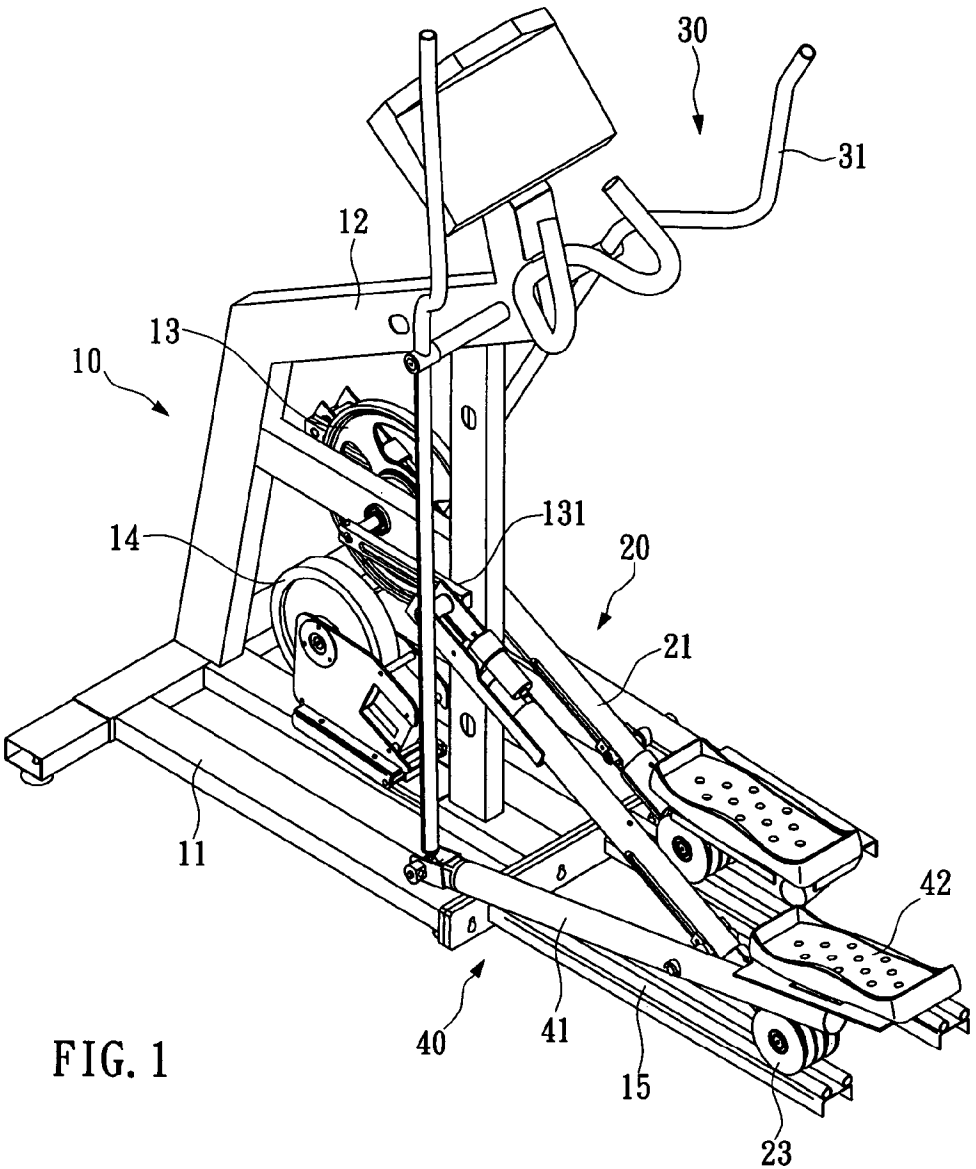
FIG. 1 is a perspective view of an embodiment of the present invention.
Figure 2:
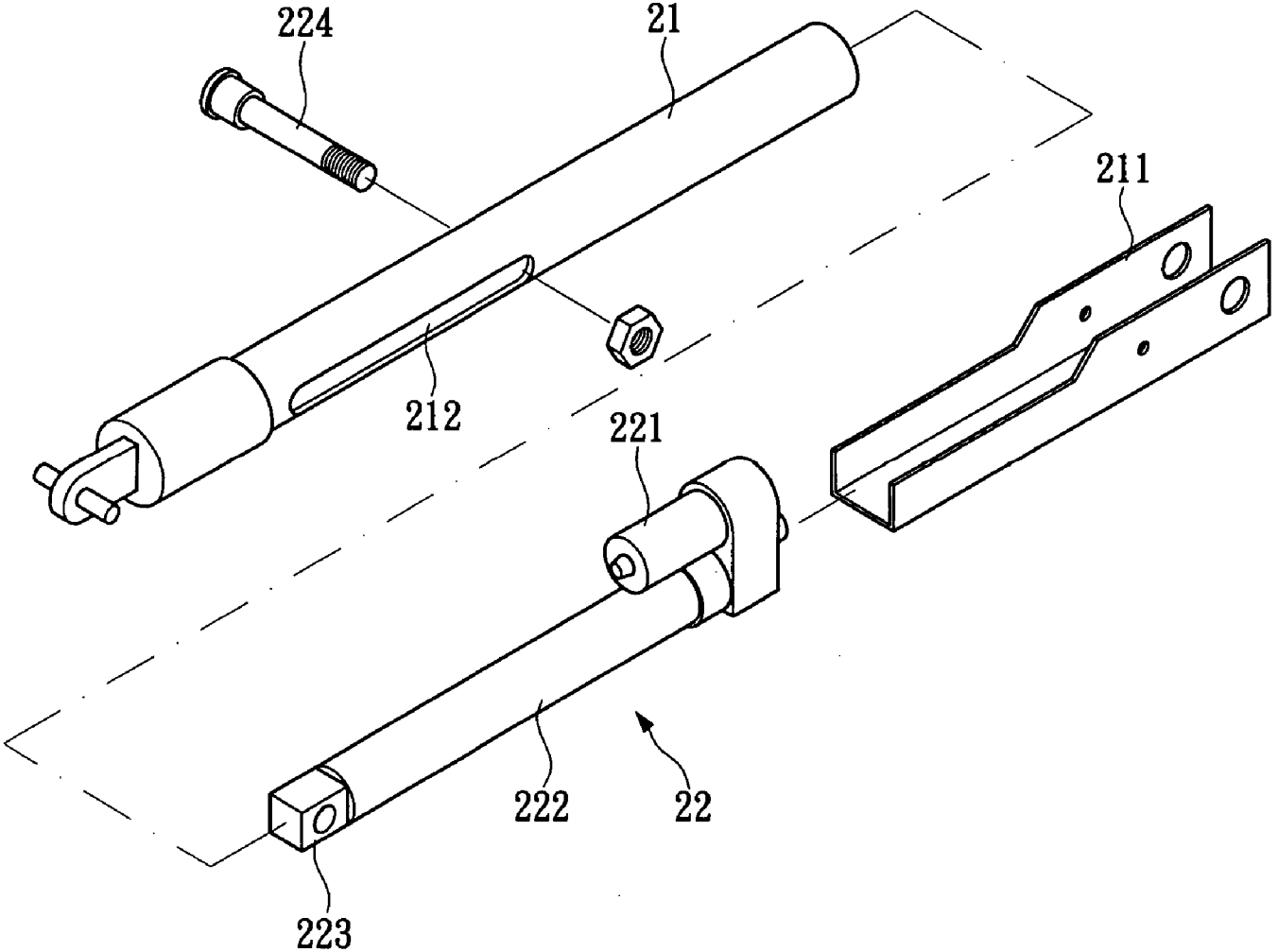
FIG. 2 is an exploded view of wheel-shafts of the present invention.
Figure 3:
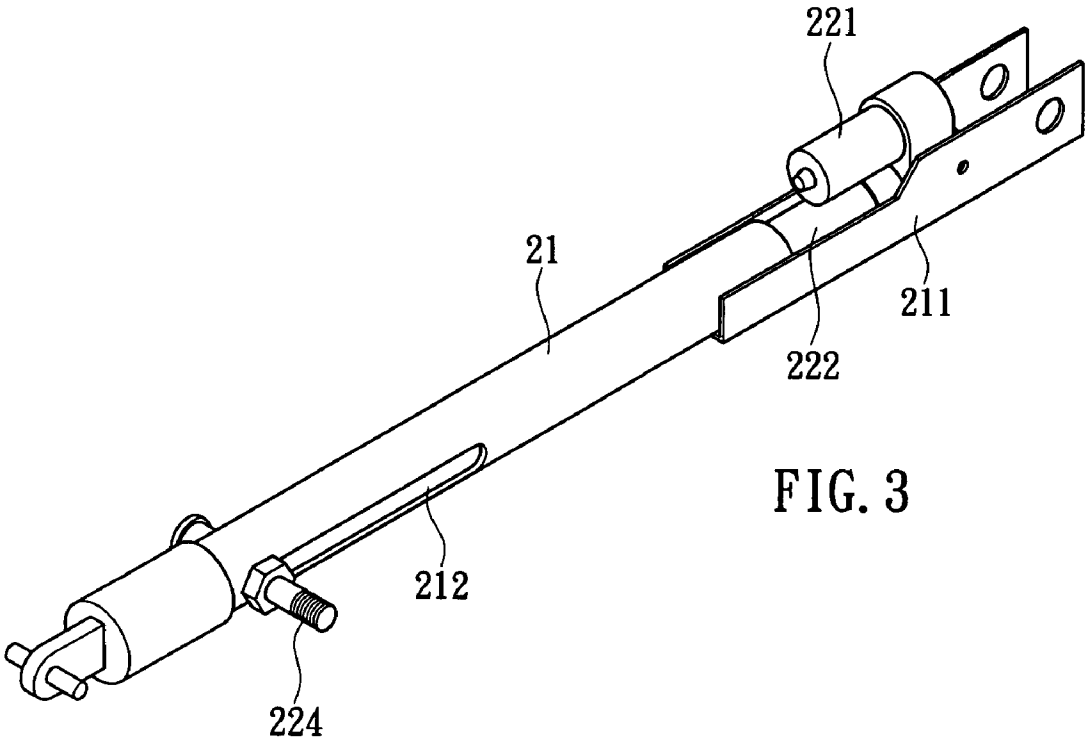
FIG. 3 is a perspective view of the wheel-shaft of the present invention.

FIGS. 1 to 3 describe an elliptical exercise machine with an adjustable exercising track according to the present invention, which comprises a framework 10, a wheel assembly 20, a handle-shaft assembly 30, and a stepping-pedal assembly 40.

The framework 10 includes an upright support 12 mounted on a longitudinal base member 11. A flywheel 13 is settled inside the upright support 12. A crank 131 is rotatably assembled to the flywheel 13 and a damper 14 is provided below the flywheel 13. The damper 14 is in connection with the flywheel 13 for providing an adjustable resistance to the flywheel 13. At least two parallel rails 15 are extended rearward from the longitudinal base member 11.

The wheel assembly 20 comprises at least two wheel-shafts 21 each being a cannular tube. The wheel-shafts 21 are assembled to two ends of the crank 131 with a respective retainer 211 that has an end coupled to a body of the corresponding wheel-shaft 21. Therein, each of the wheel-shafts 21 is provided with an adjusting assembly 22. The adjusting assembly 22 has a power source 221 deposited on the retainer 211 and the power source 221 may be an electric motor. An extendable rod 222 is settled inside the wheel-shaft 21 and connected to the power source 221. A driving block 223 is formed at one end of the extendable rod 222. A pin 224 is transversely penetrated through the driving block 223 while at least one sliding slot 212 is axially formed on the wheel-shaft 21 so that the power source 221 can drive the driving block 223 and the pin 224 to axially shift along the wheel-shaft 21. A wheel 23 is provided at an opposite end of the wheel-shaft 21 for being slidably engaged with the rail 15.

The handle-shaft assembly 30 comprises a pair of handle-shafts 31 disposed on two sides of the upright support 12, wherein each of the handle-shafts 31 is formed at an upper portion thereof with a handle 32 for being gripped by a user's hand.

Figure 4:
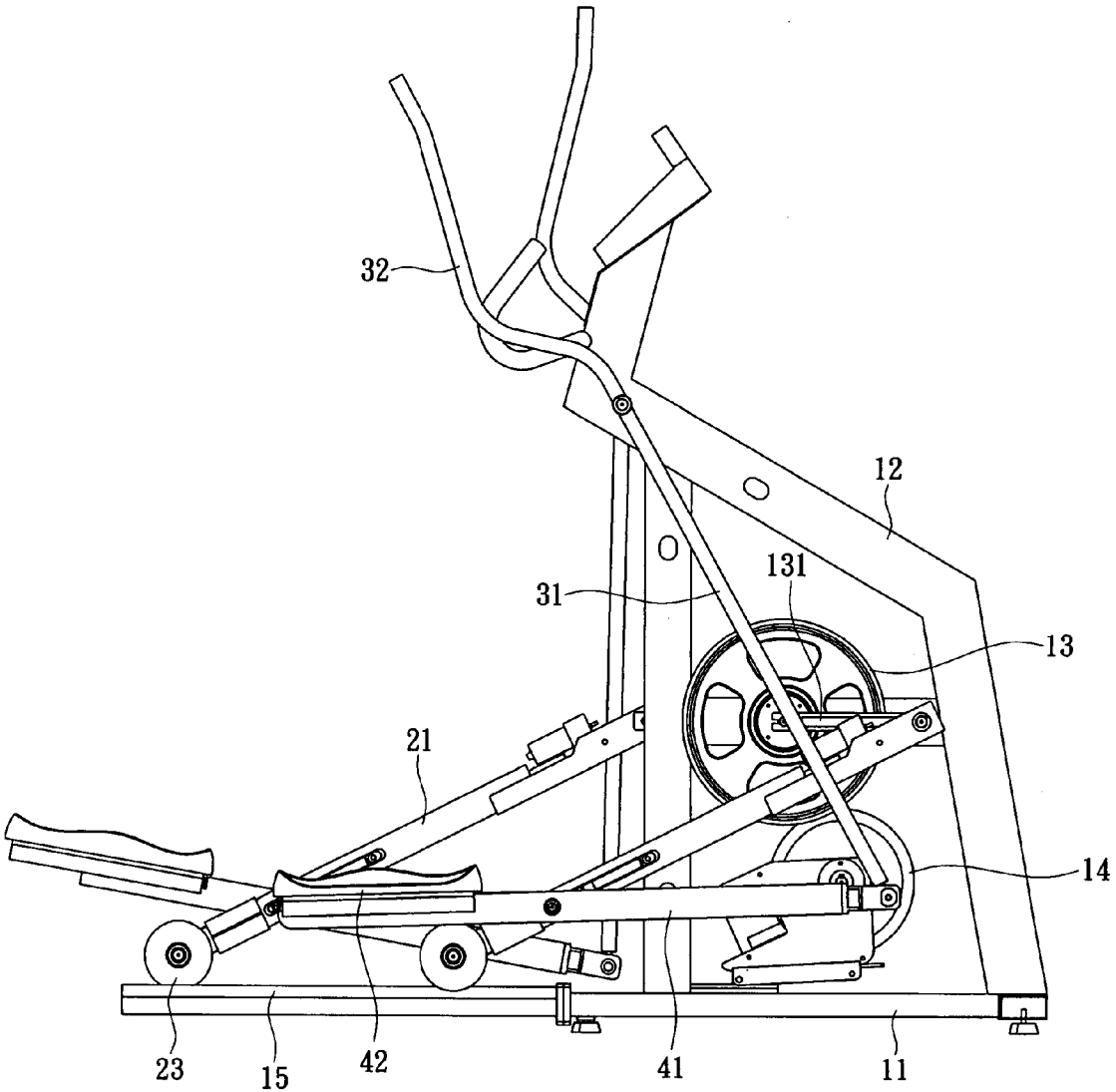
FIG. 4 is a schematic drawing showing movement of the disclosed subject matter.
Figure 5:
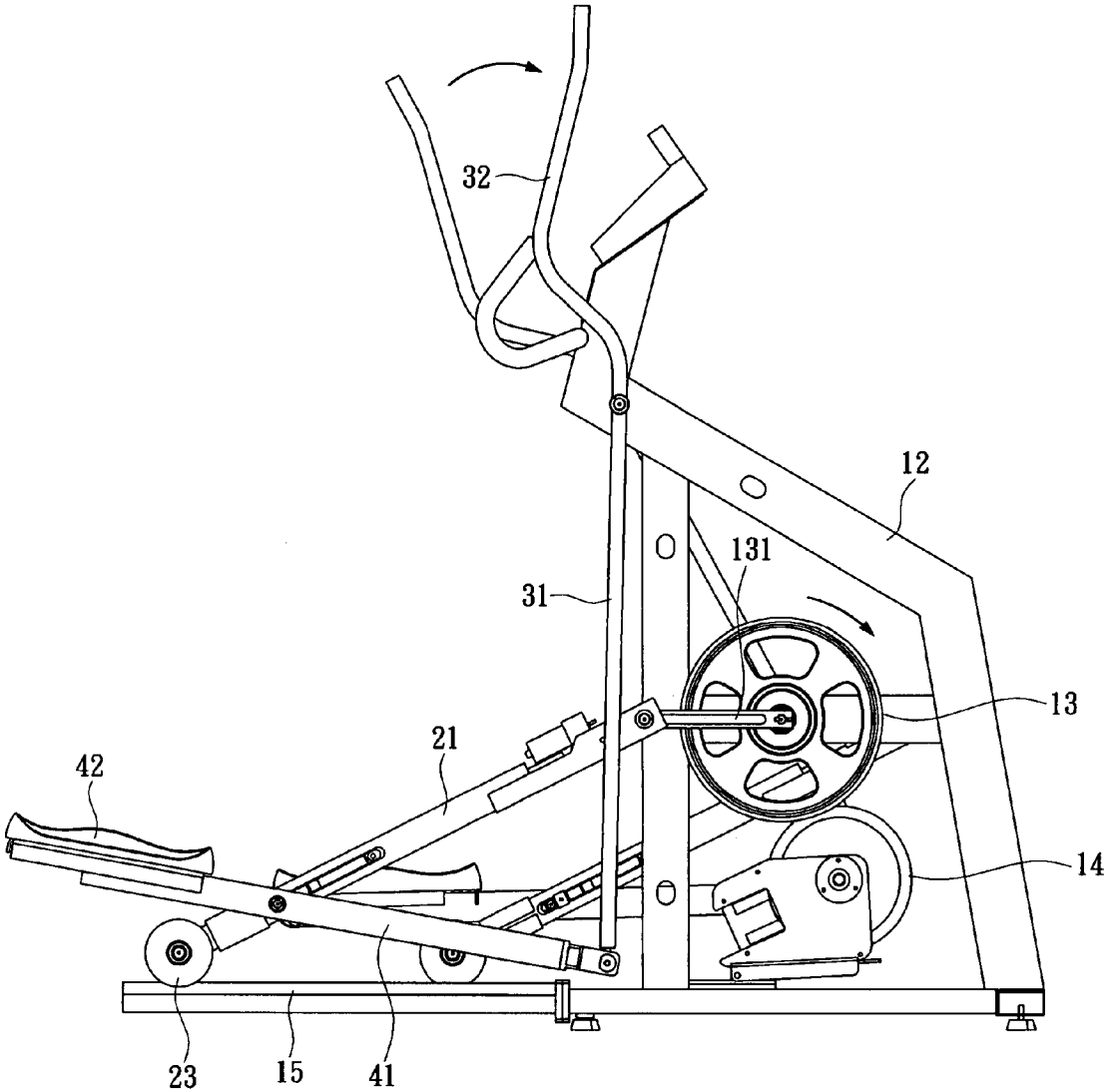
FIG. 5 is another schematic drawing showing the movement of the disclosed subject matter.
Figure 7:
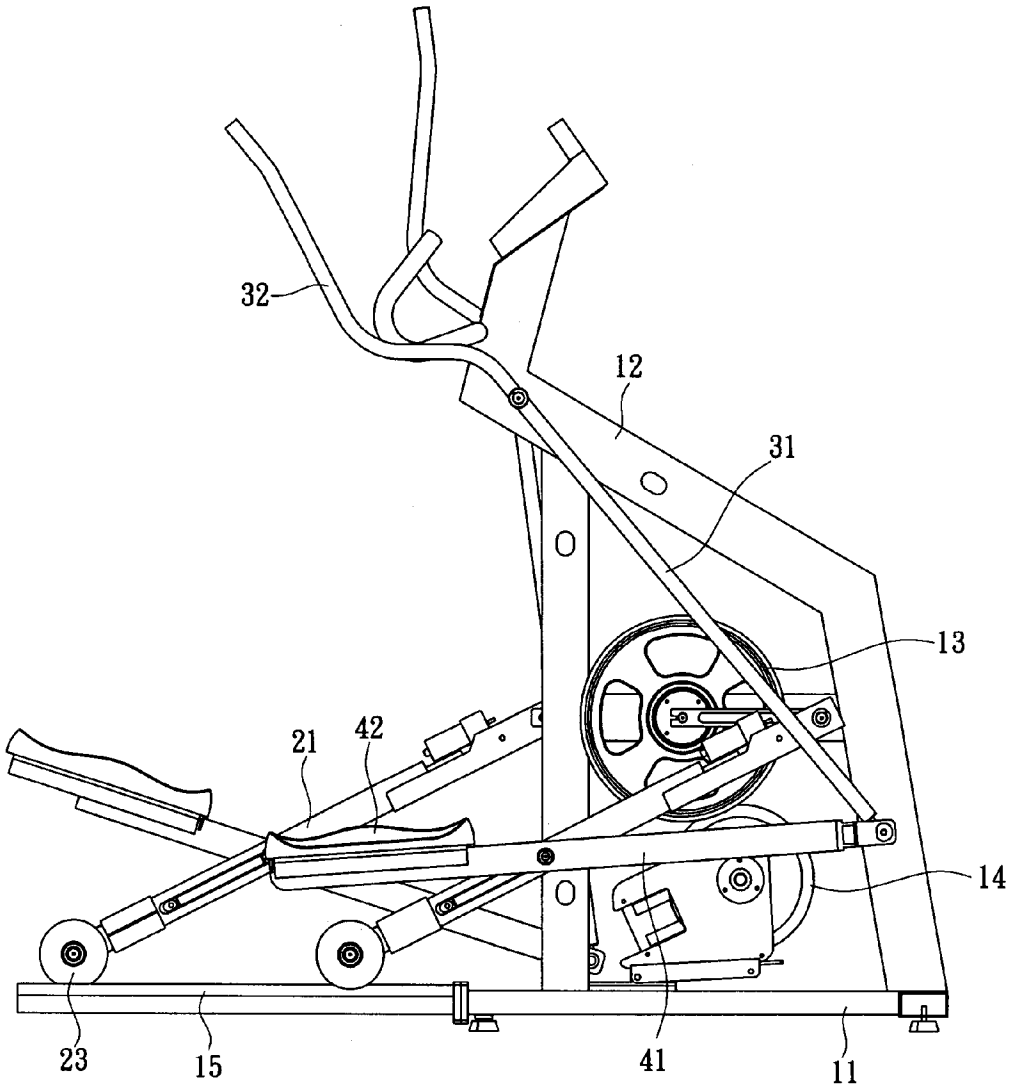
FIG. 7 is further another schematic drawing showing the movement of the disclosed subject matter.

The stepping-pedal assembly 40 comprises two pedal-shafts 41 each having one end thereof connected to a bottom of a respective said handle-shaft 31 and an opposite end pivotally combined with a respective said pin 224. Each of pedal-shafts 41 further has a pedal 42 arranged at an end thereof for being pedaled by the user's foot;

Referring to FIGS. 3 and 4, the handle-shafts 31, the pedal-shafts 41, the wheel-shafts 21, the crank 131 and the flywheel 13 are pivotally linked with each other to form a linkage mechanism. When taking exercise with the elliptical exercise machine of the present invention, a user may alternately pedal the pedals 42 and grip the handles 32. For instance, the user may step his right foot rearward while pushing the handle-shaft 31 forward with his/her right arm so as to drive the corresponding wheel 23 to move rearward along the rail 15. Thereagainst, when the user pedals the pedal 42 forward with his/her right foot and pulls the handle-shaft 31 rearward with his/her right arm, the corresponding wheel 23 moves forward along the rail 15. By alternately performing the foregoing actions, the user makes the pedals 42 move reciprocally so that a movement along a major axis of the elliptical exercising track is achieved.

Meantime, since the wheel-shafts 21 is linked with the crank 131, the foregoing movements can rotate the flywheel 13 so that the wheel-shafts 21 are driven to vertically swing upon the pins 24 so as to achieve a movement along a minor axis of the elliptical exercising track. Combining this and the above movements, the elliptical exercising track is therefore defined.

Figure 6:
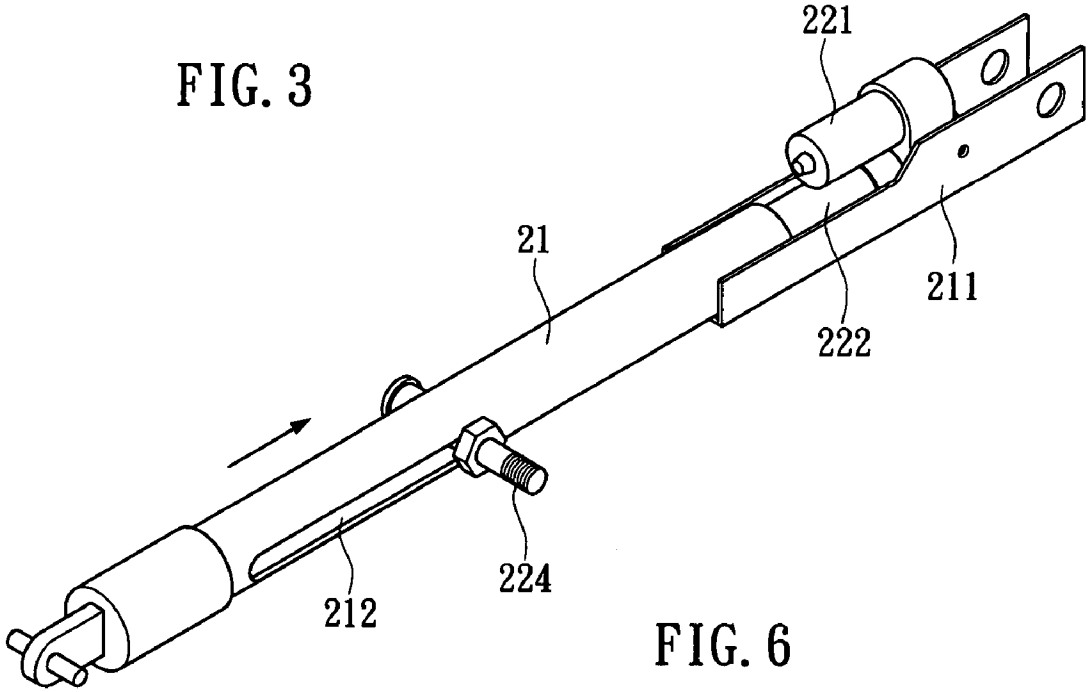
FIG. 6 is a schematic drawing showing the wheel-shaft being adjusted according to the present invention.

For adjusting the exercising track of the disclosed elliptical exercise machine, a user may lengthen the minor axis by turning on the power sources 221 to retract the extendable rods 222 and in turn bring the joints of the pins 224 and the pedal-shafts 41 to slide toward the retainers 211 (as shown in FIG. 6). As a result, the rear ends of the pedal-shafts 41 are raised. At this time, since a distance between the crank 131 and the joint of the pin 224 and the pedal-shaft 41 is shortened, the minor axis of the elliptical exercising track is correspondingly lengthened, and the overall elliptical exercising track is reformed. Therefore, the elliptical exercise machine allows the user to train his/her some other muscle systems.

On the contrary, when the user drives the power sources 221 to extend the extendable rods 222, the distance between the crank 131 and the joint of the pin 224 and the pedal-shaft 41 are lengthened so as to provide the elliptical exercising track with the shortened minor axis.

Figure 8:
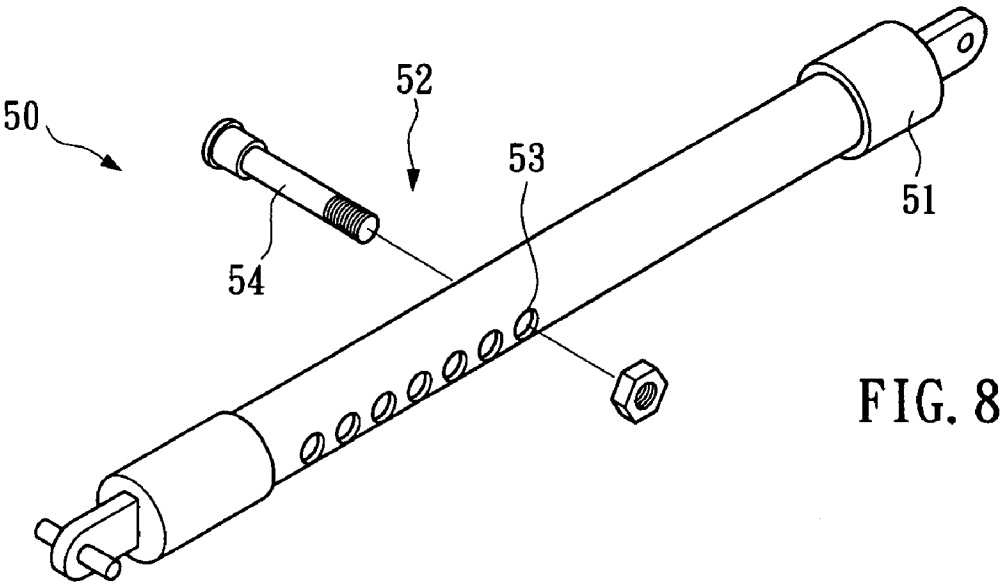
FIG. 8 is an exploded view of a wheel-shaft according to another embodiment of the present invention.
Figure 9:
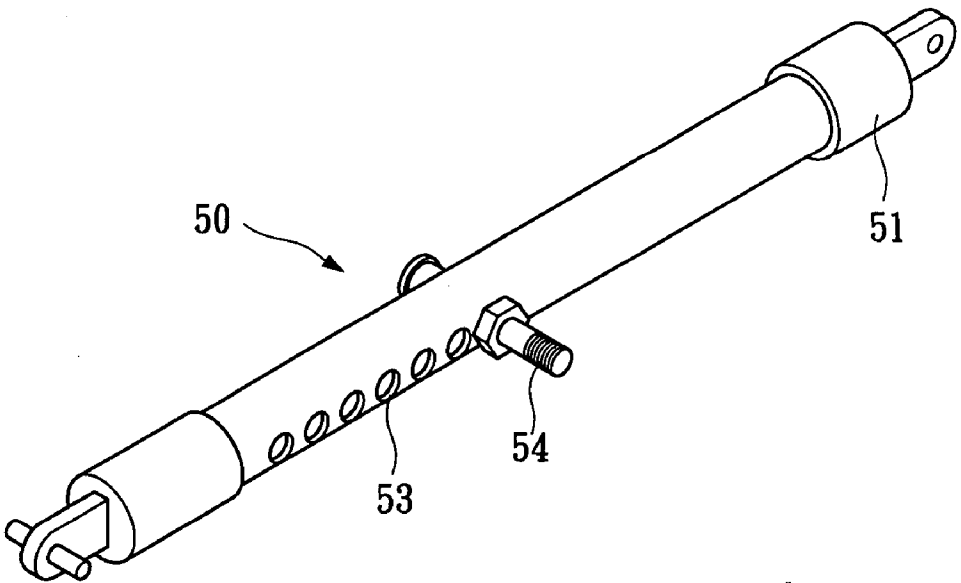
FIG. 9 is an assembly drawing of the wheel-shaft according to the second embodiment of the present invention.

According to another embodiment of the present invention as shown in FIG. 8, the disclosed elliptical exercise machine further comprises a wheel assembly 50 instead of the wheel assembly 20 of the former embodiment. The wheel assembly 50 includes at least two wheel-shafts 51 pivotally connected to the two ends of the crank 131. Each of the wheel-shafts 51 is provided with an adjusting assembly 52 that includes a plurality of through holes 53 formed on the wheel-shaft 51 as a row, and a pin 54 detachably combined with one of the through holes 53 so that the pedal-shaft 41 can be pivotally combined therewith.

For adjusting the exercising track of the disclosed elliptical exercise machine, a user can easily change a length of the minor axis of the elliptical exercising track by removing the pedal-shaft 41, detaching the pin 54 from one said through hole 53 it combined currently, re-coupling it to another said through hole 53 and reassembling the pedal-shaft 41.

While the invention has been described by way of example and in terms of two preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What the invention claimed is:

1. An elliptical exercise machine having an adjustable elliptical foot path, comprising:

a framework, including a longitudinal base member combined with an upright support, a flywheel disposed in the upright support, a pair of cranks disposed on the flywheel, and at least two parallel rails arranged along the longitudinal base member;

a wheel assembly, including two wheel-shafts, each having one end pivotally combined with one end of a respective said the crank and having an opposite end provided with a wheel which is slidably engaged with a respective said rail;

a handle-shaft assembly, comprising a pair of handle-shafts disposed at two sides of the upright support wherein each of the handle-shafts has a top portion for being gripped by a hand of a user;

a pedal-shaft assembly, comprising two pedal-shafts each having one end coupled with a bottom of a respective said handle-shaft and an opposite end provided with a user foot pedal for said respective pedal-shafts and said wheel-shafts have respective joints interconnected at their non-end locations;

wherein each of the wheel-shafts is equipped with an adjusting assembly that is pivotally connected to an end of a respective said pedal-shaft near the pedal and serves to shift a position of said joints of the pedal-shaft and the wheel-shaft along a longitudinal axis of the wheel-shaft;

whereby a minor axis of the elliptical exercising track can be changed so as to non-proportionally scale the has been changed to foot path of the elliptical exercise machine and in turn allow the user to exercise in diverse exercise modes for training various muscle systems of the user.

2. The elliptical exercise machine as claimed in claim 1, wherein each of the wheel-shafts is a cannular tube and the adjusting assembly comprises an axially expandable rod settled in each said wheel-shaft.

3. The elliptical exercise machine as claimed in claim 2, wherein the adjusting assembly comprises a power source located on the wheel-shaft for extending or retracting the expandable rod.

4. The elliptical exercise machine as claimed in claim 3, wherein the power source is an electric motor.

5. The elliptical exercise machine as claimed in claim 4, wherein a driving block is provided at an opposite end of each of the expandable rods and at least one sliding slot is formed on each said wheel-shaft correspondingly so that a pin transversely piercing through the driving block can jut out the sliding slot to be pivotally connected by the pedal-shaft.

6. The elliptical exercise machine as claimed in claim 5, wherein a retainer has one end pivotally connected to the end of the crank and an opposite end connected to a body of the wheel-shaft.

7. The elliptical exercise machine as claimed in claim 1, wherein a damper is located below the flywheel for providing an adjustable resistance to the flywheel.

8. The elliptical exercise machine as claimed in claim 1, wherein, the adjusting assembly comprises a plurality of through holes formed on the wheel-shaft as a row.

9. The elliptical exercise machine as claimed in claim 8, wherein the adjusting assembly further includes a pin detachably combined with one of the through holes for pivotal assembly with the pedal-shaft.

* * * * *